United States Patent [19]

Trisolini

[11] Patent Number: 4,642,832

[45] Date of Patent: Feb. 17, 1987

[54] FLOOR-WASHING APPARATUS PROVIDED WITH A SELF-WRINGING DEVICE

[76] Inventor: Giorgio S. Trisolini, Via Donatello, 5, 74019 Palagiano (Taranto), Italy

[21] Appl. No.: 721,851

[22] Filed: Apr. 10, 1985

[30] Foreign Application Priority Data

Apr. 17, 1984 [IT] Italy ..... 66302 A/84
Mar. 18, 1985 [IT] Italy ..... 35689/85[U]

[51] Int. Cl.[4] ..... A47L 13/58
[52] U.S. Cl. ..... 15/3; 15/260
[58] Field of Search ..... 15/3, 119 R, 120 R, 15/260

[56] References Cited

U.S. PATENT DOCUMENTS 4,464,809 8/1984 Trisolini ..... 15/3

FOREIGN PATENT DOCUMENTS 716584 12/1931 France ..... 15/119 R

*Primary Examiner*—Edward L. Roberts
*Attorney, Agent, or Firm*—Browdy and Neimark

[57] ABSTRACT

The apparatus consists of a stick (1) supporting a box-shaped structure (2) forming a container (3) in which a rotating basket (10) provided with holes is housed; the basket (10) is actuated by a first motor means (16) and houses an axially slidable rod (17) rotatably supporting a floor-cloth (18) and driven in the two senses by a second motor means (21) so that the floor-cloth attached thereto is moved between two end positions, that is a position in which it is completely inside the basket (10) and a position in which it is completely withdrawn thereform, said floor-cloth (18) being rotated by the action of the basket (10) not only when it has to be wringed but also when it has to be stretched out on the floor.

12 Claims, 3 Drawing Figures

FIG. 2
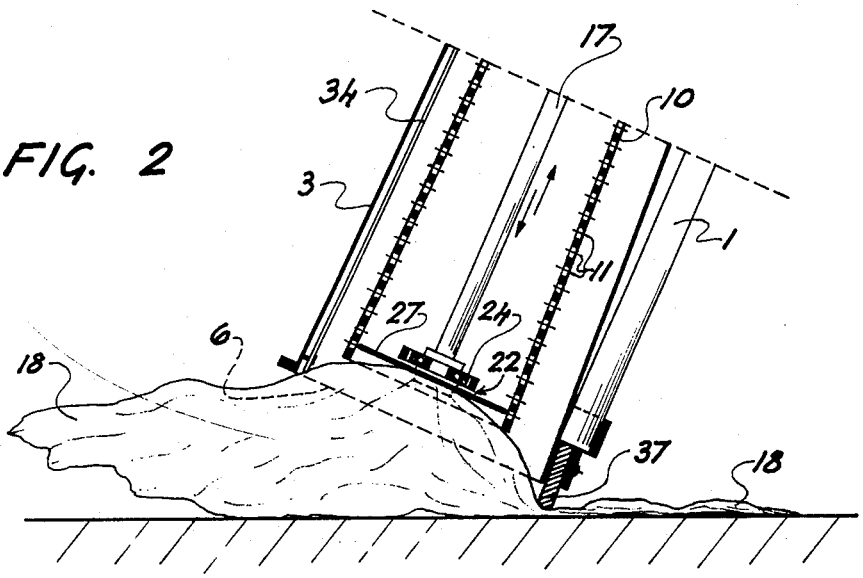
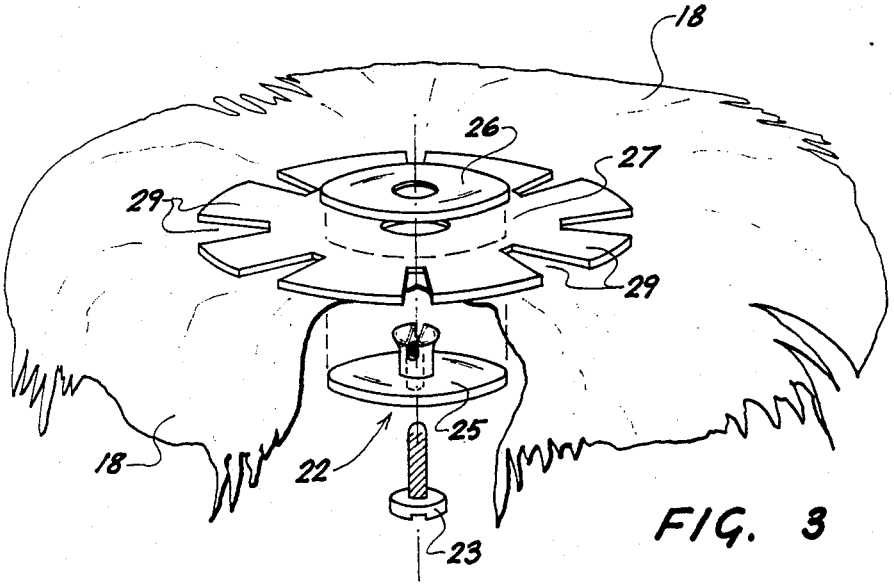
FIG. 3

FLOOR-WASHING APPARATUS PROVIDED WITH A SELF-WRINGING DEVICE

FIELD OF THE INVENTION

The present invention generally relates to a floor-washing apparatus provided with a self-wringing device for eliminating the residual water from a floor-cloth and with means capable of automatizing the functions thereof.

The subject apparatus can have a valid application on whatever situation in which it is necessary to carry out the washing of floors or wide surfaces either in flats or in community houses, hotels or industrial buildings.

The fundamental object aimed at by said invention is the accomplishment of a floor-washing apparatus of easy and practical use, provided with a cloth-wringing automatic device incorporated in the structure of the apparatus itself and actuated by a self-contained motor means, so that all steps in succession, i.e. washing, distribution of a cleansing agent, rinsing and drying, can be carried out readily, quickly and with the slightest effort.

BACKGROUND OF THE INVENTION

The applicant is the owner of a previously filed patent application, Ser. No. 562,869 filed Dec. 19, 1983, entitled "Self-Wringing Mop," disclosing a floor-washing apparatus made up of a single body essentially consisting of a floor-cloth mounted at the end of a stem adapted to be rotated by a motor means. The motor means is integral to a rod that can be axially moved by hand so that the floor-cloth can be put inside a basket provided with holes and withdrawn therefrom when it has to be laid down on the floor to be washed. Suitable electrical contacts allow the actuation of the motor means when the floor-cloth is inside said perforated basket so that, by means of said stem, the floor-cloth is rotated and the perforated basket, carried along therewith, is rotated too. Under those conditions, by effect of the centrifugal force, the floor-cloth drenched with the dirty washing water is pressed against the inner walls of the basket so that the water will tend to come out of the latter through the holes thereof and the floor-cloth will get suitably wringed and therefore ready to be used again over the floor.

Although the apparatus according to the above described solution attains the fundamental intended purposes, some drawbacks have emerged from its continuous use which can be summarized as follows:

the operation of the control axis for moving the floor-cloth in and out must be carried out by hand and the motor means integral thereto is axially dragged along, which involves a certain effort on the part of the operator;

the motor means can only be actuated by moving the same close to the limit switches and by keeping it in contact therewith (holding the rod manually in that position) for the time necessary to execute a complete wring of the floor-cloth;

the structure of the apparatus involves some difficulties in construction due to the number, arrangement and cooperation of the movable and/or rotating parts;

the operation of stretching out the cloth on the floor after the same has been wringed and withdrawn from the perforated basket, is not easy unless the operator assists it manually.

OBJECTS

The object of the present invention is to eliminate the above mentioned drawbacks, carrying out some improvements to the above described floor-washing apparatus so that it may become still handier and more practical in use and require a slighter effort on the part of the operator.

A further object of the invention is to allow, through suitable motor means, the automatic moving of the floor-cloth in the two senses from one position inside the perforated basket to a position outside the same when it is spread out on the floor for being used over it.

A still further object of the invention is to provide an apparatus equipped with a tank containing water, liquid cleansing agents, waxes and the like, and with means adapted to distribute said substances in a regulated manner close to the floor-cloth.

A still further object of the invention is to provide a floor-cloth and means destined to fasten it adapted to allow the same to be rotated at whatever inner or outer position thereof with respect to the basket and even while it is being passed over the floor so that it may be stretched out in the best manner and in order to promote the proper distribution of liquid cleansing agents or waxes thereon and to increase its scrubbing action as well.

SUMMARY OF THE INVENTION

The foregoing and still further objects are achieved by the improved floor-washing apparatus provided with a self-wringing device according to the present invention, generally comprising:

a basket rotatably fastened to a support body, inwardly integral to a container through a rotary motion transmitting means connected, above said body, to a first motor means;

a floor-cloth rotatably fixed to the lower end of a rod extending longitudinally inside said basket and free to slide axially through said means designed to transmit a rotary motion to the basket;

and wherein:

said rod is provided, on at least one side of its surface and over at least a portion of its length, with longitudinally extending cogs meshing with a sprocket wheel exhibited by a second motor means disposed above said support body too;

said second motor means controls the axial motion of said rod and therefore said floor-cloth between two positions so that the latter may be disposed inside the basket or withdrawn therefrom;

said first motor means causes the basket to rotate and said floor-cloth is caused to rotate too carried along by the basket itself, when it is in both said positions and in further intermediate positions;

the floor-cloth when disposed inside the rotating basket, is pressed against the perforated inner wall of the basket and, owing to the centrifugal force, the washing liquids contained therein are removed and can get out through the perforated wall of the basket;

close to the upper end of a box-shaped structure is provided a tank designed to contain cleansing liquids, waxes and the like and equipped with a device capable of ensuring a regular distribution of these liquids on the floor-cloth.

BRIEF DESCRIPTION OF THE DRAWINGS

Further features and advantages of the invention will become more apparent from the following detailed description of a preferred embodiment given hereinafter by way of example only, with reference to the accompanying drawings, in which:

FIG. 2 shows a detail of the apparatus seen in FIG. 1 with the floor-cloth completely at the outside and ready to be used over a floor;

FIG. 3 is an exploded perspective view of the floor-cloth according to the invention.

DESCRIPTION OF THE PREFERRED EMBODIMENT

Figure 1:
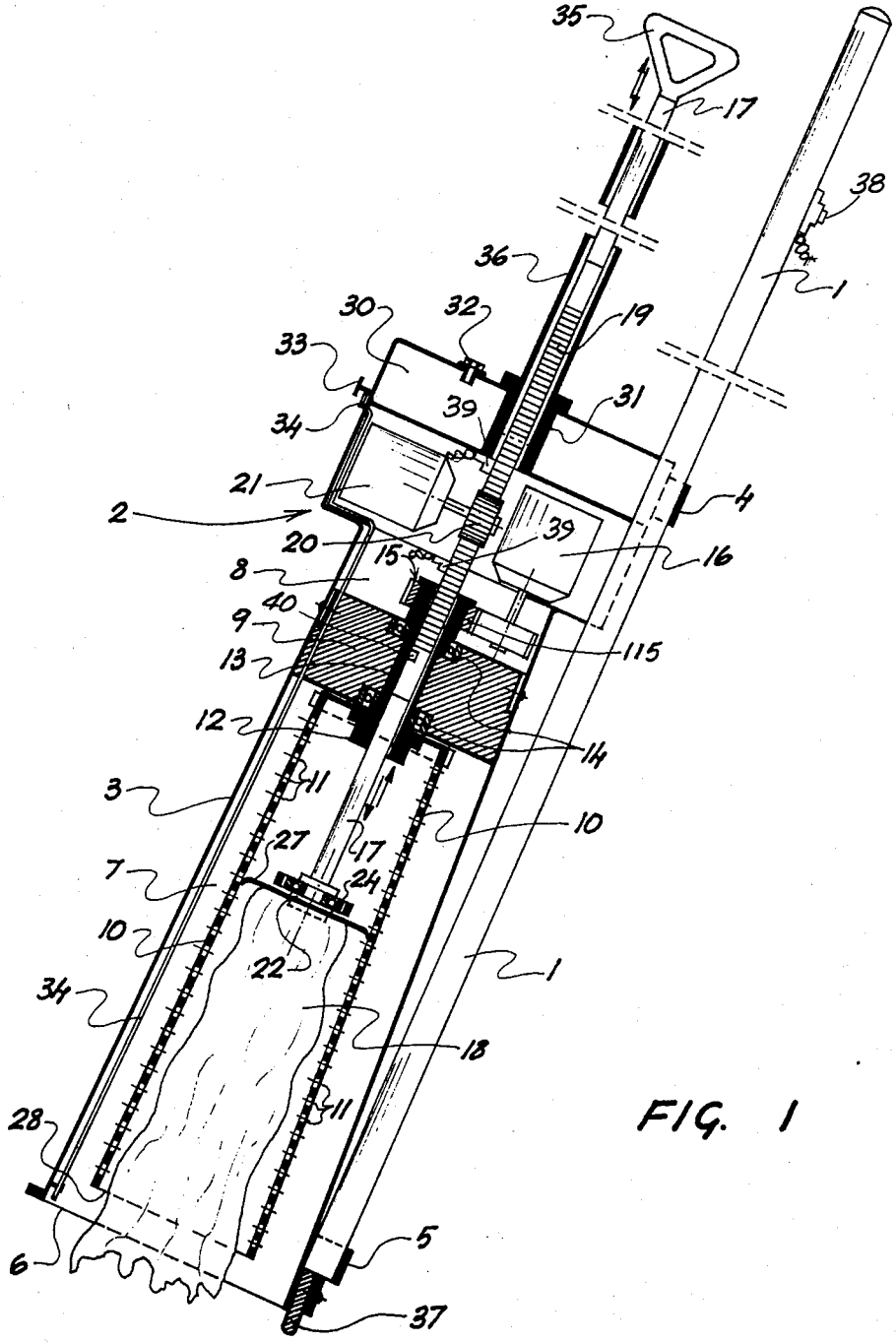
FIG. 1 is a cross-sectional view of an apparatus according to the invention with the floor-cloth in an intermediate position.

Referring to the drawings and particularly to FIG. 1, the apparatus according to the invention comprises a long stick 1 supporting a box-shaped structure 2 forming a container 3. The stick is fastened to the box-shaped structure 2 by two ties 4 and 5 that make it integral thereto. The container 3 may be of any longitudinally extending shape and is open at its lower end 6.

The inside of the container 3 is divided into two chambers 7 and 8 by a support body 9 fastened to the inner walls thereof. The lower chamber 7, extending from said body 9 to the open end 6, houses a longitudinally extending cylindrical basket 10 provided with a number of regularly distributed holes 11 occupying the whole surface thereof and open at its lower end in register with the container 3.

The perforated basket 10 is rotatably fastened to the support body 9 by a stop nut 12 rigidly connecting the basket to a tubular element 13 passing through the body 9 and rotatably fixed to the latter by means of bearings 14. Upwardly the tubular element 13 terminates within in said chamber 8 and is connected to drive members 15, 115 designed to transmit a rotary motion and connected to a first motor means 16 housed in said chamber.

According to a possible embodiment, said drive members 15, 115 may consist of a pair of gear wheels as seen in FIG. 1 or, alternatively of a pair of pulleys and corresponding driving belts or the like. According to the embodiment shown in the figure, the tubular element 13 supports one of said gear wheels or pulleys of the drive member 15 or one of them is obtained therein. According to an alternative embodiment the tubular element 13 may be integral to the basket structure 10 and engaged with the body 9 by means of the drive members 15, 115 themselves.

The tubular element 13 houses a rod 17 passing through it and freely sliding inside it; said rod terminates inside the basket 10 and rotatably carries, at the lower end thereof, a floor-cloth 18.

The rod 17 is provided, on at least one side of its surface and over at least a portion of its length, with longitudinal cogs 19 meshing with a sprocket wheel 20 provided on a second motor means 21 housed in the chamber 8 too, above said support body 9. The second motor means 21 causes the axial movement of the rod 17 and therefore of the floor-cloth 18 between two end positions: in the first position the floor-cloth 18 is almost entirely inside the basket 10 while in the second position the floor-cloth is withdrawn from the basket and comes out of the open end 6 of the container 3, as shown in FIG. 2.

When, due to the action of the motor means 21 the floor-cloth 18 is completely pulled in within the basket 10 and the motor means 16 is actuated, the basket begins to rotate and causes the floor-cloth 18, pivotally mounted on the rod 17, to rotate too; thus the floor-cloth is pressed against the inner wall of the basket so that, by effect of the centrifugal force, the water and the residual liquids contained in the floor-cloth are removed out passing through the basket holes and the floor-cloth is properly wringed and ready to be used again over a dirty floor.

The floor-cloth 18 is fastened to the end of rod 17 by a fastening element 22 adapted to be connected, in a firm but removable manner and by common means 23, such as screws, bolts and the like, to a bush or a bearing 24 exhibited by the end of the rod 17 (FIGS. 1 and 2) so that the floor-cloth can rotate independently of the rod.

Said fastening element 22 (see FIG. 3) consists of two rigid half-bodies 25 and 26 suitable to be associated with each other in a rigid and removable manner. Between said two half-bodies 25 and 26 are interposed and engaged the floor-cloth 18 and a flat element 27 disposed on top of the floor-cloth and made of semi-rigid elastic material, of a substantially circular shape and the diameter of which corresponds to the inner diameter of the open lower end 28 of the basket 10 (FIGS. 1 and 2).

The floor-cloth 18 can be rotated together with the basket 10 by effect of the centrifugal force only when it is almost entirely within said basket and the wringing operation is taking place. On the contrary, said flat element 27 allows the floor-cloth 18 to be rotated also when it is almost entirely withdrawn from the basket 10, as shown in FIG. 2. That allows to exploit the rotation of the floor-cloth in order to spread it out on the floor when pulled out of the basket 10 after the wring without needing any manual intervention. Furthermore, it allows to exploit the rotation of the spread-out floor-cloth 18 in order to achieve a better distribution of the washing liquids or a stronger scrubbing action. More generally, the flat element 27 allows the floor-cloth 18 to be rotated by the action of the basket 10 at any intermediate position thereof, between the two end positions described above, according to the requirements.

In a preferred embodiment the flat element 27 is provided at its periphery with a number of regularly spaced projections and/or notches 29 intended to ensure the best contact of the same with the inner surface of the basket 10.

Close to the upper end of the box-shaped structure 2, there is a tank 30 incorporated therein or applied thereto; it has a cylindrical cavity 31 almost in the middle through which the rod 17 freely passes and slides. The tank 30 is provided with an inlet closed by a plug 32 and with an adjustable cock 33 connected to a duct 34 for the supply of the liquids (water, cleansing agents, waxes and the like) contained in said tank. Said duct 34 is disposed inside the container 3 close to the inner surface thereof and terminates at the level of the open end 6 of the latter so that the liquids may be distributed directly on the floor-cloth 18 or close thereto (FIGS. 1 and 2).

Said rod 17, as shown in FIG. 1, is provided at its upper end with a handle 35 for its manual emergency operation and is housed and guided while moving in the two senses by a hollow cylindrical body 36 rigidly integral to the box-shaped structure 2.

Said first and second motor means 16 and 21 consists of normal electrically powered motors energized by direct or alternating current and a multifunction switch 38 is provided on the stick 1 for switching them on or off. Limit switches 39, 40 are also provided close to the ends of the toothed portion 19 of the rod 17, designed to disactivate the second motor means 21 when the floor-cloth 18 reaches one of its two end positions.

Finally the container 3 is provided, in the region of its open end 6 and sideways with respect to the same, with a horizontally disposed strip 37 made of semi-rigid plastic material which acts as a spatula for collecting the water or other liquids on the floor and as a grasping edge as well, being adapted to grasp the floor-cloth 18 and drag it along on the floor, as seen in FIG. 2.

It is understood that the foregoing description has been given purely as an unlimited example and that modifications of a practical and technical nature may be made to the constructional details of the apparatus without in any way departing from the spirit and scope of the invention as defined in the claims appended thereto.

What is claimed is:

1. An improved floor-washing apparatus including a self-wringing device, comprising:

a handle (1);

a housing (2) including an upper portion, a lower portion in which is disposed a container (3) having an open bottom end (6) and support means dividing said housing into said upper and lower portions;

a cage (10), substantially cylindrical in shape and exhibiting a regularly perforated surface, located within the container (3) and having an open bottom end (28) positioned adjacent the open bottom end (6) of the container (3), said cage being rotatably coupled at the top end thereof with said support means (9);

a mop (18);

means, supporting at least a top end of said mop within said cage, for moving said top end between a first limit position in which the mop is substantially fully retracted into the cage (10), and a second limit position in which the mop is substantially free of the cage (10), said cage (10) being mounted rotatably on the support (9) by annular drive means (15) coupled at a point above the support to a first motor (16), said first motor and said drive means cooperating to transmit rotation to said cage;

said mop (18) being rotatably coupled with the bottom end of said moving means and disposed longitudinally within the cage for free sliding movement through said drive means;

at least one side of said moving means being formed as a rack (19) extending at least a part of the length thereof;

a second motor (21) supported at a location above said support and including a pinion (20) for driving said rack, whereby said second motor imparts axial movement to said moving means, and hence the mop, between the two limit positions in which the mop is retracted into the cage, or extended to be substantially free thereof;

said first motor producing rotation of said cage by way of said drive means (15) and a substantially circular flat component (27) fitted coaxially to said driving means, integral with said mop, and frictionally engaged with the inner wall of the cage, so that the mop rotates in each of the two limit positions, and in positions intermediate thereof;

said mop being urged against the inner wall of said cage, when in the retracted limit position and in rotation, such that residual washing liquid is expelled therefrom and drained from said cage;

and a tank (30), provided at the upper portion of the housing (2), for liquid, detergent, wax and other cleaning aids, said tank including means (32, 33, 34) for metering the cleaning aids onto or around the mop (18).

2. The floor-washing apparatus as in claim 1, wherein said drive means (15) comprises a tubular element (13) passing through said support (9) and mounted rotatably thereto by way of bearings (14), said tubular element terminating at a point above the support and cooperating with said drive means coupled to the first motor (16);

and a locknut (12) for clamping the cage (10) to said tubular element (13); and said tubular element (13) defines a cylindrical seat for slidably supporting said moving means extending therethrough.

3. The floor-washing apparatus as in claim 1, wherein said drive means comprise a gear pair.

4. The floor-washing apparatus as in claim 1, wherein said drive means are embodied as a pair of pulleys interconnected by a drive belt.

5. The floor-washing apparatus as in claim 1, wherein said mop is rotatably attached to the bottom end of said moving means by way of a fitting (22) made integral with, and separable from, bearing means (24) at the bottom end of the rod by means of a conventional fastener (23);

said fitting (22) comprising two rigid removably fastenable halves (25, 26) between which the mop (18) is clamped, said substantially circular flat component (27) comprising a semi-flexible material and having a diameter matching the internal diameter of the bottom end (28) of the cage (10), such that the peripheral part of the component rides against the internal surface of the cage and creates a friction drive by means of which rotation is transmitted to the mop while the mop is in any given position between said two limit positions.

6. The floor-washing apparatus as in claim 5, wherein the periphery of the semi-flexible flat component (27) exhibits a plurality of circumferentially spaced notches (29) for enhancing the engagement between the peripheral part of the flat component and the internal surface of the cage.

7. The floor-washing apparatus as in claim 1, wherein the tank (30) includes a substantially central bore (31) of cylindrical shape accommodating and affording sliding passage to said driving means, a filler and cap (32) for replenishing said tank, and an adjustable valve (33) connected with a tube (34) for dispensing liquids held in the tank;

said tube being located inside the container (3) and extending along its internal surface, said tube terminating at the open bottom end (6) of the container in such a way as to dispense liquid either directly onto, or around the mop (18).

8. The floor-washing apparatus as in claim 1, wherein the top end of said moving means is provided with a grip (35) permitting maneuver of said moving means by hand in emergency, said moving means top end being slidingly supported for movement in reversible directions within a cylindrical body (36) integral with said housing (2).

9. The floor-washing apparatus as in claim 1, wherein said first and second motors (16, 21) are conventional electric motors operated from either a d.c. or an a.c. power source.

10. The floor-washing apparatus as in claim 1, and further including a multifuction switch for operation and control of the first and second motors (16, 21), and limit switches located at either end of the rack (19) and triggered by said moving means for shutting off the second motor (21) whenever either of the two limit positions of the mop (18) is reached.

11. The floor-washing apparatus as in claim 1, wherein one side of the open bottom end (6) of the container (3) is fitted with a horizontally-disposed strip (37) of semi-flexible material which serves as a squeegee for gathering up water or other liquids from the floor, and as a skirt for gathering and pushing the mop (18) over the floor.

12. An improved floor-washing apparatus including a self-wringing device, comprising:

a handle (1);

a housing (2) including an upper portion, a lower portion in which is disposed a container (3) having an open bottom end (6) and support means dividing said housing into said upper and lower portions;

a cage (10), substantially cylindrical in shape and exhibiting a regularly perforated surface, located within the container (3) and having an open bottom end (28) positioned adjacent the open bottom end (6) of the container (3), said cage being rotatably coupled at the top end thereof with said support means (9);

a mop (18);

means, supporting at least an upper end of said mop within said cage, for moving said upper end between a first limit position in which the mop is substantially fully retracted into the cage (10), and a second limit position in which the mop is substantially free of the cage (10), first motor means supported by said housing and including first means for driving said cage in rotation;

second motor means supported by said housing and including second means for driving said moving means to and between said first and second limit positions;

said second driving means having one end disposed within said cage, said one end including means for coupling said second driving means with said cage so that said mop and said cage rotate together wherever said mop is positioned within said cage;

whereby the mop is urged against the inner wall of the perforated cage when in the first limit position and upon rotation of said cage, residual washing liquid is expelled therefrom and drained from the cage;

and a tank (30), provided at the upper portion of the housing (2), for liquid, detergent, wax and other cleaning aids, said tank including means (32, 33, 34) for metering the cleaning aids onto or around the mop (18).

* * * * *